US007220906B2

(12) United States Patent
Sasaki

(10) Patent No.: US 7,220,906 B2
(45) Date of Patent: May 22, 2007

(54) STRING-INSTRUMENT TYPE ELECTRONIC MUSICAL INSTRUMENT

(75) Inventor: Michihiko Sasaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 34 days.

(21) Appl. No.: 10/802,575

(22) Filed: Mar. 16, 2004

(65) Prior Publication Data

US 2004/0182219 A1 Sep. 23, 2004

(30) Foreign Application Priority Data

Mar. 20, 2003 (JP) ..... 2003-078545
Feb. 17, 2004 (JP) ..... 2004-039515

(51) Int. Cl.
*A63J 17/00* (2006.01)

(52) U.S. Cl. ..... 84/464 A

(58) Field of Classification Search ..... 84/464 R, 84/464 A

See application file for complete search history.

(56) References Cited

U.S. PATENT DOCUMENTS 4,236,191 A * 11/1980 Martinez ..... 362/554
4,563,933 A * 1/1986 Kim ..... 84/267
4,745,837 A * 5/1988 Rimsa ..... 84/291
5,408,914 A * 4/1995 Breitweiser et al. ..... 84/477 R
5,796,025 A * 8/1998 Haake ..... 84/464 R
6,379,244 B1 4/2002 Sagawa et al.
6,461,239 B1 10/2002 Sagawa et al.
6,541,688 B2 * 4/2003 Asahi ..... 84/477 R
6,815,599 B2 * 11/2004 Asahi ..... 84/485 R
2003/0154842 A1 * 8/2003 Steiger ..... 84/267
2004/0139847 A1 * 7/2004 Aiba ..... 84/722

FOREIGN PATENT DOCUMENTS

JP 05-029094 4/1993
JP 05-059388 8/1993
JP 2000-350861 12/2000
JP 2002-251182 9/2002
JP 2002-087750 10/2002
JP 2002-287742 10/2002

* cited by examiner

*Primary Examiner*—Jeffrey W Donels
(74) *Attorney, Agent, or Firm*—Morrison & Foerster LLP

(57) ABSTRACT

Light emitting sections are provided in proximity to a plurality of performance operators that are provided, on the body of an electronic musical instrument, for performing tone-generation instructing operation corresponding to operation of strings on a natural musical instrument, and the light emitting sections illuminate the performance operators with controlled light emission. Thus, a human operator can visually identify the position of each performance operator to be operated with an enhanced visibility. Further, because the light emitting sections are provided in proximity to the performance operators to allow the instrument body to appear shining to persons viewing the human player playing the musical instrument, the persons can view the performance operation by the human player with an enhanced visibility.

12 Claims, 3 Drawing Sheets

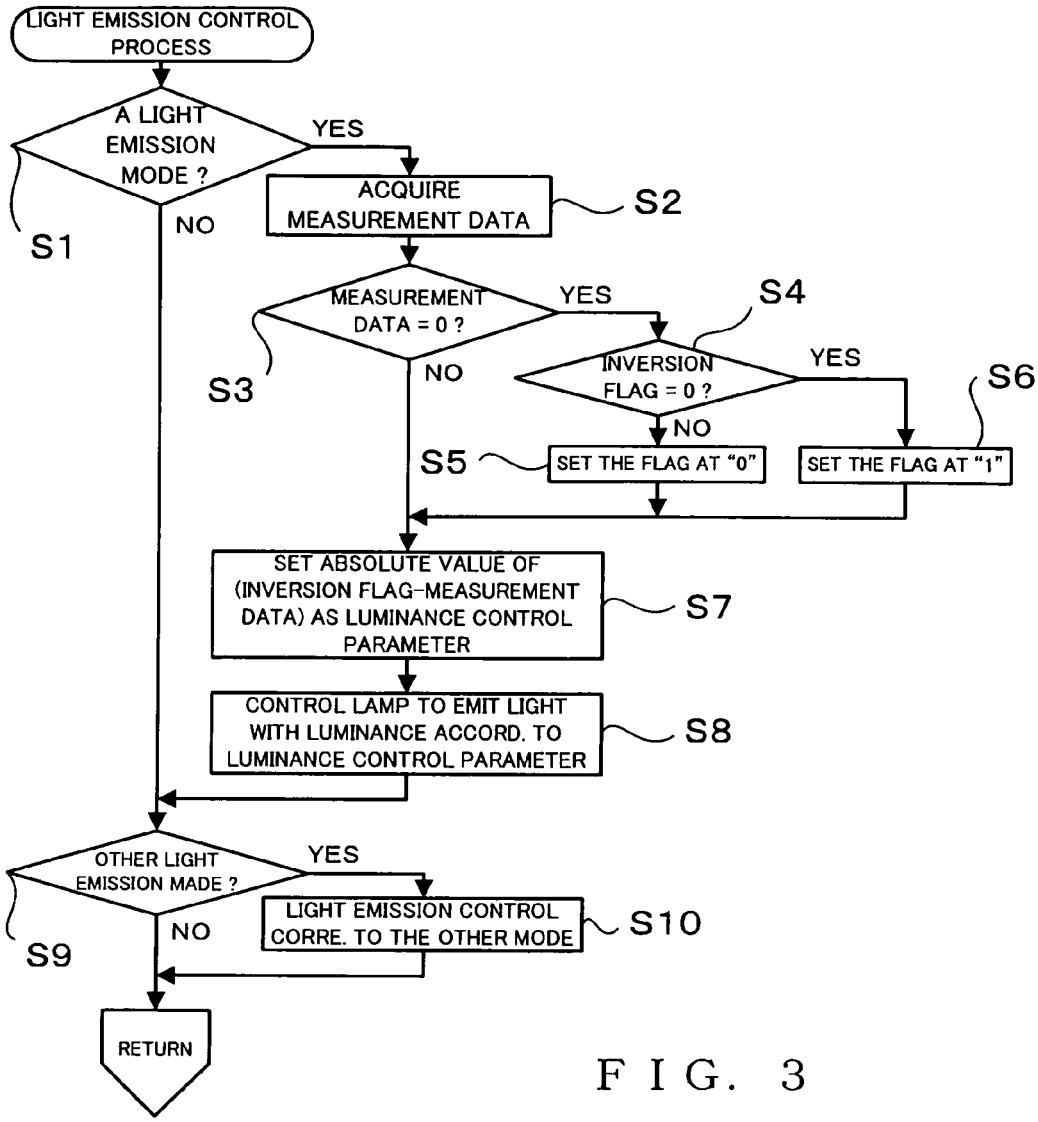
F I G. 3
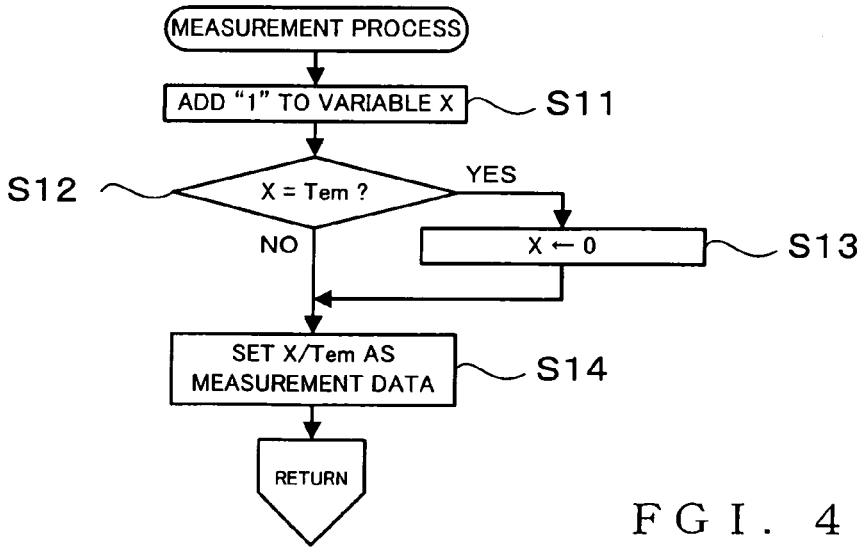
F G I. 4

STRING-INSTRUMENT TYPE ELECTRONIC MUSICAL INSTRUMENT

BACKGROUND OF THE INVENTION

The present invention relates generally to string-instrument type (string-operating type) electronic musical instruments which are constructed by imitating the construction of natural musical instruments and which electronically generate tones in response to operation of predetermined performance operators provided in correspondence with performance operators of the natural musical instruments. More particularly, the present invention relates to an improved string-instrument type (string-operating type) electronic musical instrument which not only allows a human operator of the instrument to view or visually identify performance operators with an enhanced visibility but also allows one or more persons (e.g., audience), viewing the human operator playing the instrument, to view performance operation by the human with an enhanced visibility.

To date, there have been known electronic musical instruments which are constructed by imitating the construction of natural musical instruments and which electronically generate tones in response to operation of predetermined performance operators provided in correspondence with performance operators of the natural musical instruments (e.g., Japanese Patent Application Laid-open Publication No. 2002-287742). Namely, these electronic musical instruments, which are equipped with a multiplicity of the performance operators operable by the human player similarly to the corresponding natural musical instruments, generate tones in accordance with pitches, tone generation timing, etc. determined on the basis of operation, by the human player, of some of the performance operators. For example, in electronic musical instruments imitating a natural stringed musical instrument, such as a guitar or ukulele, there are provided a plurality of pitch designating operators at predetermined positions corresponding to positions of individual frets on a neck section of the natural stringed musical instrument, and a plurality of tone-generation instructing operators at predetermined positions corresponding to string-plucking or string-operating positions of the natural stringed musical instrument. In the field of these string-operating type electronic musical instruments, it has been known and practiced to sequentially illuminate the pitch designating operators in accordance with a progression of a music piece, in order to provide the human player with a performance guide to indicate each performance operator to be operated and/or in order to visually entertain persons viewing the human player playing the electronic musical instrument.

However, in the above-mentioned conventional electronic musical instruments, only the pitch designating operators provided at the predetermined positions, corresponding to the fret positions, among the multiplicity of performance operators are illuminated; namely, the tone-generation instructing operators are not illuminated at all. Heretofore, it has been conventional to indicate, to the player, timing to operate the tone-generation instructing operators by means of very small light emitting elements provided at positions separate from the instructing operators. Therefore, the tone-generation instructing operators tend to be less visible than the pitch designating operators, and it is very difficult to identify the right timing to operate the predetermined tone-generation instructing operators. Particularly, for a human player playing on a dark stage etc., the tone-generation instructing operators, which are not illuminated unlike the pitch designating operators, are very difficult to visually identify as compared with the pitch designating operators, and thus the human player tends to operate wrong tone generation instructing operators. Besides, because the small-size light emitting elements are difficult to view, there would arise another problem that the human player tends to operate the tone-generation instructing operators at wrong timing.

Further, because only the pitch designating operators are illuminated on the neck section, the performance operation, by the human player, of the tone-generation instructing operators tends to be difficult for the persons, viewing the human player playing the instrument, to view, and thus the performance as a whole tends to be dull and boring from the viewpoint of a visual effect.

SUMMARY OF THE INVENTION

In view of the foregoing, it is an object of the present invention to provide a string-instrument type electronic musical instrument which can not only indicate, to a human operator, performance operators (particularly, tone-generation instructing operators) to be operated with an enhanced visibility but also indicate, to any person viewing the human player playing the instrument, performance operation by the human player with an enhanced visibility, and which can also impart a visual expressional effect synchronous with generated tones.

In order to accomplish the above-mentioned object, the present invention provides an improved string-instrument (string-operating) type electronic musical instrument, which comprises: a sounding section provided in a substantial central portion of a body of the electronic musical instrument corresponding to a sound hole of a stringed musical instrument; a plurality of performance operators provided on the body for performing tone-generation instructing operation corresponding to operation of a string on the stringed musical instrument; a light emitting section provided in proximity to the performance operators; a light emission control section that controls light emission of the light emitting section; and a tone generation processing section that generates a tone through the sounding section in response to operation of any one of the performance operators.

Because the light emitting section is provided in proximity to the plurality of performance operators, the performance operators can be illuminated with light emitted by the light emitting section under control of the light emission control section. Thus, a human player can view or visually identify the positions of the performance operators with an enhanced visibility. Further, because the light emitting section is located in proximity to the performance operators, the body of the instrument is to allowed to appear shining to persons (e.g., audience) viewing the human player playing the musical instrument, without only a neck section projecting from the body being illuminated as in the conventional counterparts, so that the persons can view the performance operation by the human player with an enhanced visibility. In addition, the present invention can also impart a visual expressional effect synchronous with generated tones.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 3 is a flow chart showing an embodiment of a light emission control process carried out in the embodiment; and FIG. 4 is a flow chart showing an embodiment of a measurement process carried out in the embodiment.

DETAILED DESCRIPTION OF THE EMBODIMENTS

Figure 1:
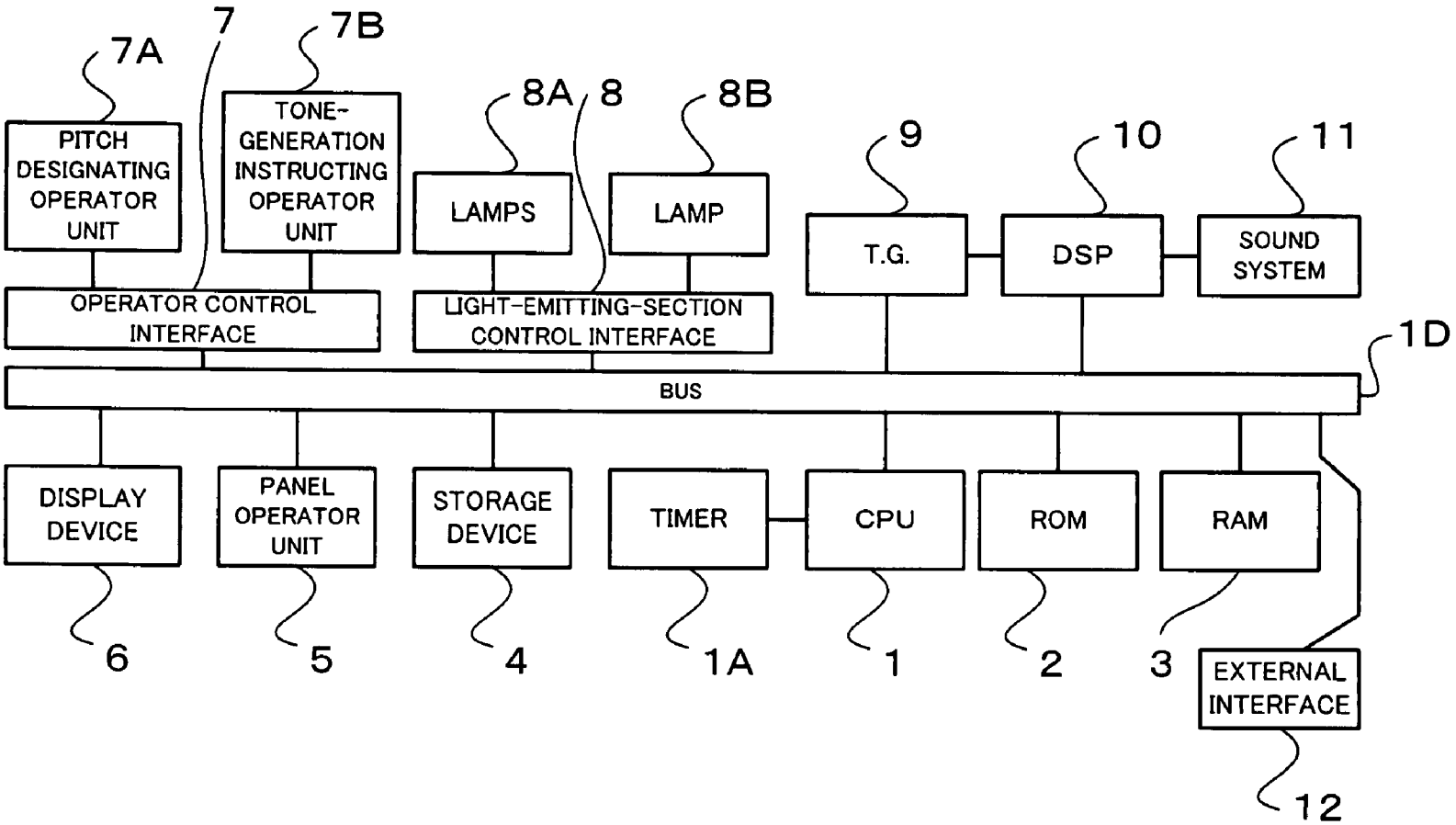
FIG. 1 is a block diagram of a general hardware setup of an electronic musical instrument in accordance with an embodiment of the present invention.

FIG. 1 is a block diagram of a general hardware setup of an electronic musical instrument in accordance with an embodiment of the present invention. In the electronic musical instrument, various processes are performed under control of a microcomputer which includes a microprocessor unit (CPU) 1, a read-only memory (ROM) 2 and a random-access memory (RAM) 3. The electronic musical instrument will be described hereinbelow as performing the processes by means of one CPU 1.

The CPU 1 controls all operations in the entire electronic musical instrument. To the CPU 1 are connected, via a communication bus (e.g., data and address bus) ID, the ROM 2, RAM 3, storage device 4, panel operator unit 5, display device 6, operator control interface 7, light-emitting-section control interface 8, tone generator (T.G.) 9, DSP (Digital Signal Processor) 10 and external interface unit 12. Also connected to the CPU 1 is a timer 1A for counting various time periods, for example, to signal interrupt timing for timer interrupt processes. For example, the timer 1A generates tempo clock pulses for counting time intervals and setting a performance tempo for automatically performing a music piece in accordance with automatic performance data. Frequency of the tempo clock pulses is adjustable, for example, via a tempo setting switch included in the panel operator unit 5. Such tempo clock pulses generated by the timer 1A are given to the CPU 1 as processing timing instructions or as interrupt instructions. The CPU 1 carries out various processes, such as an automatic performance process and performance guide process, in accordance with such interrupt instructions.

The ROM 2 has prestored therein various programs to be executed by the CPU 1 and various data to be referred to by the CPU 1. The RAM 3 is used as a working memory for temporarily storing automatic performance information, such as performance conditions, to be used for automatically performing a music piece on the basis of automatic performance data, various data generated as the CPU 1 executes a predetermined program, and various other data. The RAM 3 is also used as a memory for storing the currently-executed program and data related thereto, and for various other purposes. Predetermined address regions of the RAM 3 are allocated to various functions and used as registers, flags, tables, etc.

The storage device 4, such as a hard disk device, is provided for storing various parameters, such as performance conditions, to be used for an automatic performance, automatic performance data forming a basis of an automatic performance, control programs to be executed by the CPU 1, etc. Where a particular control program is not prestored in the ROM 2, the control program may be stored in the storage device 4, so that, by reading out the control program from the storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The storage device 4 may use any of various removable-type media other than the hard disk (HD), such as a flexible disk (FD), compact disk (CD-ROM or CD-RAM), magneto-optical disk (MO) and digital versatile disk (DVD). Alternatively, the storage device 4 may use a semiconductor memory.

The panel operator unit 5 includes various operators for designating a music piece to be automatically performed, operators for setting various parameters, such as a tone color and performance tempo, and operators for entering various performance conditions for an automatic performance, such as those to be used for practicing a performance with only a right hand and those to be used for practicing a performance with only a left hand. Of course, for selecting, setting and controlling a tone pitch, color, effect, etc., the operator unit 5 may include a numeric keypad for entering numerical value data, a keyboard for entering character and text data, and various operators, such as a pitch bend wheel, slider, etc. capable of setting a pitch bend value corresponding to an operation amount thereof Detection circuit (not shown) constantly detects respective operational states of the individual operators on the operator unit 5 and outputs switch information, corresponding to the detected operational states of the operators, to the CPU 1 via the communication bus ID. The display device 6, which is in the form of a liquid crystal display (LCD), cathode ray tube (CRT) and/or the like, displays music piece information, such as a music piece name and artist's name, of an automatically-performed music piece, settings of various parameters, performance conditions, etc., states of an automatic performance, controlling states of the CPU 1, etc.

The operator control interface 7 is an interface operating in accordance with operation of a pitch designating operator unit 7A and tone-generation instructing operator unit 7B, i.e. communicating pitch designating information, tone-generation instructing information, etc. with the CPU 1. The pitch designating operator unit 7A includes a plurality of pitch designating operators 7A, such as a plurality of switches, provided so as to correspond to frets on a neck section of a natural stringed musical instrument like a ukulele, for selecting desired pitches of tones, and key switches provided in corresponding relation to the fret-corresponding switches. The pitch designating operator unit 7A can be used as means not only for designating tone pitches for a tone performance, but also for entering pitches, rhythms, etc. for an automatic performance. Needless to say, the pitch designating operator unit 7A may be of any desired shape other than the shape of the neck section of a natural stringed musical instrument, such as a ukulele. The tone-generation instructing operator unit 7B, on the other hand, includes a plurality of tone-generation instructing operators 7B, such as switches for determining generation timing of tones, so as to function as a plurality of so-called "pseudo strings" provided, for example, at positions corresponding to string-operating (playing) positions of a natural stringed musical instrument. The tone-generation instructing operator unit 7B also includes sensors, such as piezoelectric sensors, in corresponding relation to the pseudo strings, so that tone generation timing can be designated for a tone performance by the sensors detecting vibration of the pseudo strings.

The light-emitting-section control interface 8 is an interface for communicating (transmitting and receiving) control information for illumination control of lamps represented by 8A and 8B, etc. with (to and from) the CPU 1. The lamps 8A are intended to provide a visual performance guide to indicate each pitch designating operator 7A to be operated by a human player or user in accordance with automatic performance data; specifically, the lamps 8A are light emitting elements, such as LEDs, that are illuminated slightly before or at the same time as predetermined performance timing. The lamps 8A are positioned in close proximity to the plurality of pitch designating operators 7A or at locations where they can illuminate the pitch designating operators 7A themselves. The lamp 8B is intended to provide a visual performance guide to indicate operation timing of each tone-generation instructing operator 7B to be operated by the user in accordance with the automatic performance data. The lamp 8B is a light emitting element, such as an LED, that is illuminated/deilluminated in accordance with a tempo of an automatic performance. Alternatively, the lamp 8B may be illuminated in accordance with tone generation timing (or performance guide timing) of the automatic performance data or operation, by the user, of the tone-generation instructing operators 7B, without being limited to illumination/deillumination according to the performance tempo. In such a case, any desired one of manners or styles of controlling the illumination of the lamp 8B may be chosen by the user. By looking at the illumination of these lamps 8A and 8B, the user is allowed to readily identify the respective positions of the pitch designating operators 7A to be operated, and the respective operation timing of the tone-generation instructing operators 7B.

The tone generator 9, which is capable of simultaneously generating tone signals in a plurality of channels, receives performance information, such as automatic performance data supplied thereto via the communication bus ID and pitch designating information and tone-generation instructing information generated in accordance with operation, by the user, of the pitch designating operators 7A and tone-generation instructing operators 7B. On the basis of the received performance information, the tone generator 9 generates tone signals. Each of the tone signals thus generated by the tone generator 9 is subjected to predetermined digital signal processing by the DSP 10, after which it is audibly reproduced or sounded by a sound system 11 including an amplifier, speaker, etc. In the instant embodiment, the speaker (i.e., sounding section) is provided at a position corresponding to the sound hole of a natural ukulele and has a similar shape to the sound hole, as will be later described. Thus, the embodiment of the electronic musical instrument can have a similar overall shape to the corresponding natural musical instrument and can generate tones at similar positions to the corresponding natural musical instrument, so that it can significantly reduce differences from the corresponding natural musical instrument.

The automatic performance data may be either in a digitally-coded format, such as the SMF (Standard MIDI File) format, or in a waveform sample data format, such as the PCM, DPCM or ADPCM. Further, although not specifically shown, an effector circuit may be provided between the tone generator 9 and the sound system 11 so as to impart various effects to the tone signals generated by the tone generator 9. The tone generator 9, DSP 110 and sound system 11 (and effector circuit) may be constructed in any suitable conventional manner. For example, the tone generator 9 may employ any of the conventional tone synthesis methods, such as the FM, PCM, physical model and formant synthesis methods. Further, the tone generator 9 may be implemented by either dedicated hardware or software processing performed by the CPU 1.

The external interface (I/F) 12 comprises a MIDI interface or communication interface provided for communicating various information, such as automatic performance data, between the electronic musical instrument and external equipment (in this case, other MIDI equipment). The MIDI interface receives and delivers control information of the MIDI standard (MIDI data) from and to the external equipment. The other MIDI equipment may be one including any desired operator unit, such as a keyboard type, guitar type, wind instrument type, percussion instrument type, gesture type, or it may be of any desired operating type, as long as it can generate MIDI data in response to operation thereof by the user. The communication interface is connected to a wired or wireless communication network, such as a LAN (Local Area Network), the Internet or telephone network, via which it may be connected to external equipment (in this case, personal computer, server computer or the like) so as to input automatic performance data, generated by the external equipment, to the electronic musical instrument. The communication interface is also used to download, to the body of the electronic musical instrument, various programs, various data, etc. from a server computer connected via the communication network to the musical instrument. Note that the communication interface may be constructed to be capable of both wired and wireless communication rather than just one of the wired and wireless communication.

Note that, in the case where the external interface 12 comprises the MIDI interface, the MIDI interface may be a general-purpose interface rather than a dedicated MIDI interface, such as RS232-C, USB (Universal Serial Bus) or IEEE1394, in which case other data than MIDI event data may be communicated at the same time. Where some general-purpose interface as mentioned above is used as the MIDI interface, the other MIDI equipment may be constructed to be capable of communicating other data than MIDI event data. Needless to say, the data to be communicated may be of any desired format than the MIDI format, in which case the MIDI interface and other MIDI equipment are constructed in conformity with the data format used.

Figure 2A:
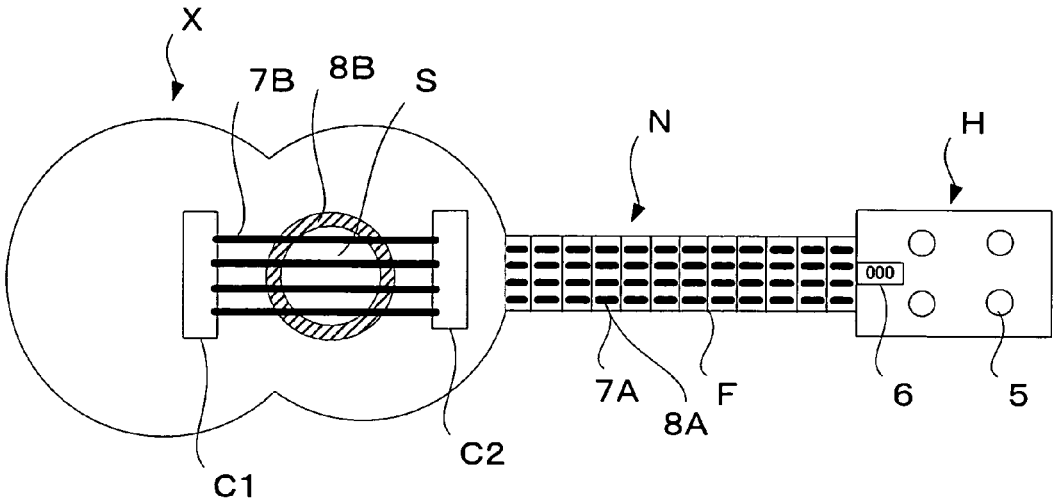
FIG. 2A is a schematic top plan view showing an example of an outer structure of the electronic musical instrument.
Figure 2B:
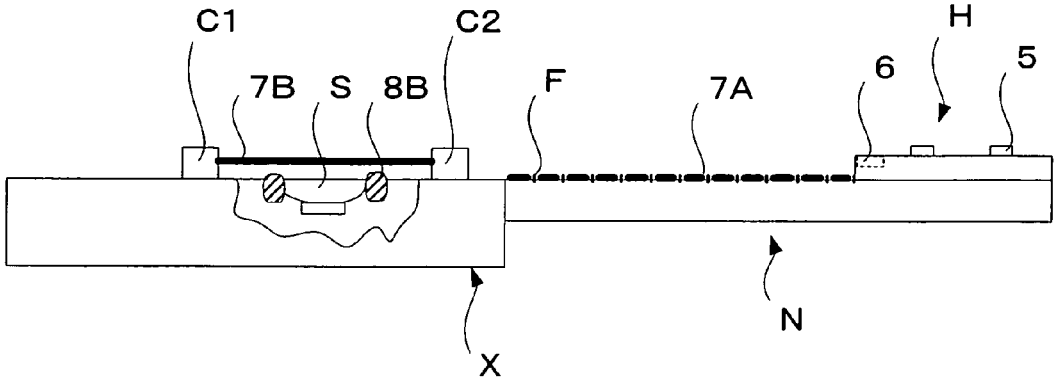
FIG. 2B is a partly-sectional side view of the electronic musical instrument.

Now, a description will be given about a specific outer structure of the electronic musical instrument of the present invention, with reference to FIGS. 2A and 2B. FIG. 2A is a schematic top plan view showing an embodiment of the outer structure of the electronic musical instrument, while FIG. 2B is a partly-sectional side view of the electronic musical instrument. The embodiment will be described in relation to a ukulele-type electronic musical instrument (electronic ukulele) that is constructed into an overall shape imitating that of a natural ukulele with four strings and twelve frets. Also, although not specifically shown in these figures, the external interface 12 etc. shown in FIG. 1 may be provided on the upper and/or side surface of a body section X of the ukulele-type electronic musical instrument.

The embodiment of the ukulele-type electronic musical instrument includes the body section X, neck section N and head section H. On the body section X, there are provided a plurality of the pseudo strings (tone-generation instructing operators) 7B to be played in the same manner as the corresponding natural ukulele. On the neck section N, there are provided a multiplicity of fret members (fret-corresponding members) F and pitch designating operators 7A. Thus, with this electronic musical instrument, it is possible to set a pitch of each tone to be generated, by depressing any one of the pitch designating operators 7A, provided on the neck section N per fret in a row consisting of the same number of the operators 7A as the pseudo strings 7B, in just the same manner as where a portion of any one string located between frets of the natural ukulele is depressed with the left hand, and by plucking the corresponding pseudo string 7B on the body section X in just the same manner as where any one string of the natural ukulele is plucked with the right hand. Namely, the embodiment of the electronic musical instrument is an "electronic ukulele" simulative of performance operation and tone generation of the natural ukulele.

As seen from the external views of FIGS. 2A and 2B, the panel operators 5, display device 6, etc. are provided on the head section H, although these components may be provided on the upper surface of the body section X or side surface or underside of the head section H or neck section N, rather than the upper surface of the head section H. Now referring to a detailed structure of the neck section N, a multiplicity of the fret members F and pitch designating operators 7A are provided on the neck section N, and a tone pitch is designated and input in response to operation of any one of the pitch designating operators 7A. In the instant ukulele-type electronic musical instrument, the fret members F do not function exactly like the frets of the natural ukulele that determine vibrating lengths of the strings; instead, the fret members F function to give visual indications of the respective positions of the pitch designating operators 7A to be operated for designating different tone pitches. Also, the fret members F are constructed to be capable of being illuminated so as to provide a visual performance guide to indicate each pitch designating operator 7A to be operated. Namely, the fret members F may also have the function as the lamps 8A so as to illuminate an area corresponding to each pitch designating operator 7A to be operated in accordance with automatic performance data. Alternatively, such a performance guide for pitch designation may be provided by causing each to-be-operated pitch designating operator 7A to emit light, instead of the fret member F illuminating an area corresponding to the to-be-operated pitch designating operator 7A.

As seen in FIG. 2A, the four pseudo strings 7B, functioning as the tone-generation instructing operators on the body section X, are in the form of wires made, for example, of a metal material and having different thicknesses similarly to the strings of the natural ukulele, so that the pseudo strings 7B can simulate the strings of the natural ukulele. Vibration of each pseudo string 7B is detected by the sensor, such as a piezoelectric sensor, built in at least one of the string supports C1, C2 supporting the pseudo strings 7B, and the detected result of the vibration sensor is supplied to a control circuit (not shown). The speaker (sounding section) S for audibly reproducing tones is accommodated in a substantial central portion of the body section X and oriented outside of the electronic musical instrument. Namely, this speaker S is provided at a position corresponding to the sound hole of the natural ukulele and is shaped similarly to the sound hole. Ring-shaped lamp 8B, in the form of an LED or ordinary lamp, is secured to the upper surface of the body section X along the outer periphery of the speaker S, as depicted by slanting lines in FIG. 2A. The lamp 8B starts to be illuminated in response to a start of an automatic performance and then repeatedly illuminated/deilluminated in accordance with a performance tempo. The lamp 8B may be illuminated in accordance with tone generation timing of automatic performance data so as to indicate operation timing of the pseudo strings 7B to the human player, or the lamp 8B may be illuminated in response to operation, by the human player, of the pseudo strings 7B. Illuminated color, luminance and brightness of the lamp 8B may be varied in accordance with tones to be generated or a set performance tempo. For example, the lamp 8B may be illuminated in blue when the performance tempo is slow, but in red when the performance tempo is fast. Further, the lamp 8B may be illuminated with increased luminance or brightness when the pseudo string 7B has been operated strongly, but with reduced luminance or brightness when the pseudo string 7B has been operated weakly. In an alternative, both the illuminated color and the luminance of the lamp 8B may be varied; for example, the lamp 8B can be illuminated in light blue when a right pseudo string 7B has been operated by the human player, but in dark red when a wrong pseudo string 7B has been operated by the human player.

Namely, the instant embodiment is characterized in that the speaker S is provided at a position corresponding to the position of the sound hole of the natural ukulele and has a similar shape to the sound hole, and in that the lamp 8B is provided at and around the speaker S. By illuminating the lamp 8B in accordance with generation of tones, the instant embodiment can not only clearly indicate, to the human player, appropriate timing for operating the pseudo strings 7B provided and extending along the upper surfaces of the speaker S and lamp 8B, but also give one or more other persons (e.g., audience), viewing the human player, an improved visual expressional effect. Namely, the human player can visually identify appropriate performance timing with an increased ease, and the likelihood of the human operator erroneously operating the performance operations can be minimized because it is sufficiently light at and around the performance operators. The embodiment also achieves the benefit that, when the human player is in an ordinary performing posture, the sound-hole-corresponding position where the lamp 8B is provided can come into sight of the viewing persons more easily; thus, the persons can more easily view the performance operation of the human player. Further, because a relatively large area at and around the speaker S is illuminated, a very high visual effect can be given to the persons viewing the performance operation of the human player. In addition, the hands of the human player manipulating the performance operators can be easily seen, which should be very helpful in learning performing techniques of the human player. Furthermore, as another important benefit, the instant embodiment can have a well-organized, superior design. Note that the lamp 8B may be disposed at any other position than along the outer periphery of the speaker S, such as an appropriate position on any of the pseudo strings 7B or string supports C1, C2, near any of the pseudo strings 7B or a position related to the pseudo strings 7B.

In the interior of the body section X, there are accommodated various components, such as the above-mentioned control circuit, storage device 4, tone generator 9, DSP 10, etc. The control circuit comprises the computer including the CPU 1, ROM 2, RAM 3, etc. as shown in FIG. 1. In the control circuit, various processes, such as a performance guide process to provide a visual performance guide for designation of tone pitches, tone generation timing, etc. by illumination of the fret members F (lamps 8A) and a performance process for generating tones in accordance with automatic performance data or in response to operation by the human operator, are carried out by the computer executing computer software including predetermined control programs directed to these processes. Of course, these processes may be carried out by other means than the computer software, such as microprograms executed by the DSP (Digital Signal Processor). Alternatively, the processes may be carried out by a dedicated hardware device including discrete circuits, integrated circuitry, large-scale integrated circuitry or the like.

Note that the above-mentioned various processes, such as the performance guide process and performance process, may employ the conventionally-known techniques, and hence a detailed description about these processes is omitted here.

In addition to the above-described performance guide function, performed by independently illuminating corresponding ones of the light emitting sections, i.e. lamps 8A and lamp 8B, for indicating the positions of pitch designating operators 7A to be operated by the user and operating timing of the tone-generation instructing operators, the string-operating type electronic musical instrument of the present invention can also perform the visual effect imparting function for causing the lamps 8A and lamp 8B to emit light in an appropriate combination of light emitting modes or styles so as to enhance the visual expressional effect. Namely, in the electronic musical instrument, the lamps 8A and 8B can be controlled to emit light in an appropriate light-emitting mode so as to impart an improved visual effect by the entire electronic musical instrument during a performance standby time, i.e. prior to or at intervals between performance operation by the user (see FIG. 3 for more details). Various examples of the visual effect imparted by the instant embodiment, i.e. various styles of light emission by the light emitting sections (lamps 8A and 8B) for providing the visual effect imparting function, are contemplated by the inventor, such as; a "hole-blinking light emission" scheme in which the lamp 8B, provided at the position corresponding to the sound hole of the natural ukulele, is caused to emit light so as to slowly blink repeatedly at predetermined time intervals (e.g., at intervals of a measure); a "random fret light emission" scheme in which some of the lamps 8A, provided in corresponding relation to the frets, are caused to emit light randomly at predetermined time intervals (e.g., at intervals of two beats); and a "regular fret light emission" scheme in which the lamps 8A of the rows, provided in corresponding to the frets, are caused to simultaneously emit light in a row-by-row fashion at predetermined time intervals (e.g., at intervals of one beat) as if the emitted light from the lamps 8A were sequentially moving between the twelfth frets and the first fret. Needless to say, the above-described light emitting schemes for providing the visual effect imparting function are just illustrative; it should be appreciated that the visual effect imparting function may be provided by causing the individual lamps to emit light in any other suitable light-emitting schemes.

In order to switch between the various light-emitting schemes as noted above, it is necessary for the user to perform predetermined operation. The operation necessary for switching between the various light-emitting schemes may be simultaneously depressing all of predetermined pitch designating operators 7A provided for given frets, such as all of the pitch designating operators 7A corresponding to the first to fourth strings and provided for the first fret and all of the pitch designating operators 7A corresponding to the first to fourth strings and provided for the twelfth fret. Each time the user performs such predetermined switching operation, illumination-related setting of the electronic musical instrument can be switched in such a manner that any one of various light emission schemes, such as the above-mentioned hole-blinking light emission, random fret light emission and regular fret light emission is turned on in predetermined order. Of course, the present invention is not so limited; for example, the illumination-related setting of the electronic musical instrument may be switched to a predetermined light emission mode corresponding to operation, by the user, of a specific combination of the pitch designating operators 7A, or the illumination-related setting of the electronic musical instrument may be switched in response to operation of a dedicated switch (not shown). Further, needless to say, the electronic musical instrument may be arranged so that the time intervals at which the light emitting sections are caused to emit light, i.e. illuminated/deilluminated, may be set appropriately by the user.

Next, with reference to FIGS. 3 and 4, a description will be made about a "light emission control process" for controlling the lamps 8A and 8B in accordance with any of the above-described light emission schemes in order to provide the visual effect imparting function. FIG. 3 is a flow chart showing an embodiment of the "light emission control process", while FIG. 4 is a flow chart showing an embodiment of a "measurement process" for generating measurement data to be used in the light emission control process. The light emission control to be performed on the individual lamps to provide the visual effect imparting function will be described hereinbelow in accordance with the flow charts of FIGS. 3 and 4.

At step S1, a determination is made as to whether the electronic musical instrument is currently in an "A light emission mode", i.e. whether the current illumination-related setting is an "A light emission mode". As noted above, the illumination-related setting of the electronic musical instrument can be switched in predetermined order between a "non-light-emitting mode", "A light emission mode" and "other light emission mode" by simultaneous operation of the predetermined pitch designating operators 7A provided for given frets. In this embodiment, the "non-light-emitting mode" is a mode in which the illumination-related setting is made to inhibit the lamps 8A and 8B from emitting light for the visual effect imparting function. The "A light emission mode" is a mode in which such an illumination-related setting is made as to illuminate or deilluminate the lamp 8B, provided at the position corresponding to the sound hole of the natural ukulele, within a time corresponding, for example, to one measure in such a manner that the lamp 8B slowly emit light repeatedly at time intervals of one measure. The "other light emission mode" is a mode in whether such an illumination-related setting is made as to effect the light emission other than the "A light emission mode", such as the random fret light emission in which some of the lamps 8A are caused to emit light randomly or the regular fret light emission in which the lamps 8A of the rows are caused to simultaneously emit light sequentially in a row-by-row (fret-by-fret) fashion.

If the current illumination-related setting is the "A light emission mode" (YES determination at step S1), measurement data is acquired, at step S2, from the measurement process (to be described later in relation to FIG. 4) which is a timing measuring process operating periodically as a separate interrupt process. The measurement data is timing data generated by the measurement process of FIG. 4 and indicative of a time position, for example, within a measure. At next step S3, it is determined whether the acquired measurement data indicates a value "0" or not. If the value of the acquired measurement data is not "0", it means that the current time position is an intermediate (i.e., on-the-way) position within a measure, rather than the end of the measure, (NO determination at step S3), then control jumps to step S7. If, on the other hand, the value of the acquired measurement data is "0", namely, if the current time position is the end of the measure (YES determination at step S3), a further determination is made at step S4 as to whether or not an inversion flag is at a value "0". If the inversion flag is not at "0" (NO determination at step S4), the inversion flag is set at "0" at step S5, while, if the inversion flag is at "0" (YES determination at step S4), the inversion flag is set at "1" at step S6. The inversion flag is a flag for performing control to decrease or increase the emitted light amount of the lamp 8B as the value of the acquired measurement data increases; switching the value of the inversion flag to "0" or "1" can switch the changing (i.e., decreasing or increasing) direction of the light emitted amount of the lamp 8B to the opposite (i.e., increasing or decreasing) direction.

At next step S7, the acquired measurement data value is subtracted from the value, "0" or "1", currently set in the inversion flag, and the absolute value of the subtraction result is set as a luminance control parameter. At following step S8, the lamp 8B is controlled to emit light with the luminance adjusted on the basis of the luminance control parameter. Namely, an illuminating luminance level of the lamp 8B is calculated in accordance with the current time position within the measure, and the lamp 8B is caused to emit light with the luminance corresponding to the thus-calculated luminance level. Therefore, when the inversion flag is set at "0", the light emission by the lamp 8B is controlled so as to increase gradually as the value of the measurement data increases, while, when the inversion flag is set at "1", the light emission by the lamp 8B is controlled so as to decrease gradually as the value of the measurement data increases, Then, at step S9, a determination is made as to whether the current illumination-related setting is the "other mode". With a YES determination at step S9, light emission control corresponding to a currently-set other mode is performed at step S10; in the instant embodiment, light emission control is performed to provide the random fret light emission, regular fret light emission, or the like.

Now briefly explaining the "measurement process" of FIG. 4, a value "1" is added to a variable X at step S11. As step S12, a determination is made as to whether the variable X is equal to a predetermined value Tem that represents a user-set time length Tem corresponding, for example, to one measure. The user can set the time length Tem directly, or indirectly by setting a tempo. In the latter case, a value obtained by multiplying the set tempo value by four may be regarded as the time corresponding to one measure. If the variable X is equal to the predetermined value Tem (YES determination at step S12), the variable X is reset at step S13; in this instance, the variable X is reset to "0". At step S14, the variable X is divided by the predetermined value Tem to provide the measurement data; in this way, a current time position within the measure is calculated, and the calculated current time position is determined as the measurement data. The measurement data is used in the "light emission control process" as set forth above in relation to FIG. 3, and that illumination control is performed on the lamp 8B such that the luminance is gradually varied in accordance with the changing current time position within the measure.

With the above-described arrangements, the human operator can refer to the blinking of the lamp 8B in order to ascertain a speed of a performance to be executed by him or her, so that the player can perform with the performance speed always kept constant. The audience, on the other hand, can view the blinking illumination by the lamps 8A or lamp 8B to easily get into performed tones. Further, such presentation of light intended for a visual effect is also so fantastic to boost the feeling of the audience.

In one embodiment, the "A light emission mode" and "other light emission mode" may be set concurrently.

Further, the above-described visual effect imparting function and the performance guide function may be performed concurrently in combination. For example, one of the lamps 8A and lamp 8B may be used to perform the visual effect imparting function, and the other of the lamps 8A and lamp 8B may be used to perform the performance guide function. In such a case, an effective visual effect can be imparted not only during a performance standby time but also during execution of a performance by the human operator or user.

The electronic musical instrument of the present invention may be one that is constructed to imitate any other natural stringed musical instrument than a ukulele, such as a guitar or mandolin.

It should also be appreciated that the present invention is not limited to the electronic musical instrument where the panel operator unit 5, display device 6, tone generator 9, etc. are incorporated together in the same body of the instrument; for example, the basis principles of the present invention may also be applied to an electronic musical instrument where the above-mentioned components are provided separately and interconnected via communication means, such as an external interface and/or various communication network.

It should also be understood that the automatic performance data to be used in the electronic musical instrument of the invention may be in any desired format, such as: the "event plus absolute time" format where the time of occurrence of each performance event is represented by an absolute time within the music piece or a measure thereof, the "event plus relative time"format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, the automatic performance data may be processed, during an automatic performance, using any desired method, such as one where the cyclic processing period is varied in accordance with a set tempo or one in which the way of counting the timing data in the performance data is varied, per execution of processing, in accordance with the tempo with the processing period kept constant. Furthermore, where automatic performance data for a plurality of channels are handled in the present invention, the data for these channels may be stored together in a mixture or separately from each other on a track-by-track basis.

In summary, the present invention is characterized in that the light emitting sections are provided in proximity to a plurality of the performance operators that are provided, on the body of the electronic musical instrument, for performing tone-generation instructing operation corresponding to operation of strings of a corresponding natural musical instrument. Thus, through light emission control of the light emitting sections, the present invention can not only indicate, to the human operator, performance operators to be operated with an enhanced visibility, but also indicate, to one or more persons viewing the human player playing the musical instrument, performance operation by the human player with an enhanced visibility. In addition, the present invention can impart a superior visual expressional effect synchronous with the generated tones.

What is claimed is:

1. A string-instrument type electronic musical instrument comprising:

a sounding section provided in a substantial central portion of a body of said electronic musical instrument corresponding to a sound hole of a stringed musical instrument;

a plurality of performance operators provided on the body for performing tone-generation instructing operation corresponding to operation of a string on the stringed musical instrument;

a light emitting section provided in proximity to said performance operators and in a position corresponding to said sounding section, wherein the light emitting section is so dimensioned as to visually highlight a performance operation on said performance operators;

a light emission control section that controls light emission of said light emitting section; and a tone generating processing section that generates a tone through said sounding section in response to operation of any one of said performance operators.

2. A string-instrument type electronic musical instrument as claimed in claim 1 wherein said light emission control section controls the light emission of said light emitting section in accordance with a performance tempo.

3. A string-instrument type electronic musical instrument as claimed in claim 1 wherein said light emission control section controls the light emission of said light emitting section in accordance with a state of operation, by a human operator, of said performance operator.

4. A string-instrument type electronic musical instrument as claimed in claim 1 which is constructed by imitating a natural stringed musical instrument.

5. A string-instrument type electronic musical instrument as claimed in claim 4 wherein the natural stringed musical instrument is any one of a ukulele, guitar and mandolin.

6. A string-instrument type electronic musical instrument as claimed in claim 1 wherein said light emitting section is provided in a continuous ring shape along an outer periphery of said sounding section.

7. A string-instrument type electronic musical instrument as claimed in claim 1 wherein said performance operators include a plurality of linear members imitating strings of the stringed musical instrument.

8. A string-instrument type electronic musical instrument as claimed in claim 1 wherein said sounding section has a shape similar to a shape of the sound hole of the stringed musical instrument.

9. A string-instrument type electronic musical instrument as claimed in claim 1 which further comprises an automatic performance section, and wherein said light emission control section controls the light emission of said light emitting section in accordance with an automatic performance by said automatic performance section.

10. A string-instrument type electronic musical instrument as claimed in claim 1 wherein said light emission control section is capable of variably controlling any one of color, luminance and brightness of light emitted by said light emitting section.

11. A string-instrument type electronic musical instrument comprising:

a sounding section provided in a portion corresponding to a sound hole of a stringed musical instrument;

a plurality of performance operators provided for performing tone-generation instructing operation corresponding to operation of a string on the stringed musical instrument;

a light emitting section provided in a continuous shape along an outer periphery of said sounding section, wherein the light emitting section is so dimensioned as to visually highlight a performance operation on said performance operators;

a light emission control section that controls light emission of said light emitting section; and a tone generating processing section that generates a tone through said sounding section in response to operation of any one of said performance operators.

12. A string-instrument type electronic musical instrument as claimed in claim 11 wherein said performance operators are provided in proximity to said light emitting section.

* * * * *